US009989311B2

(12) United States Patent
Korecki et al.

(10) Patent No.: US 9,989,311 B2
(45) Date of Patent: Jun. 5, 2018

(54) MULTI-CHAMBER FURNACE FOR VACUUM CARBURIZING AND QUENCHING OF GEARS, SHAFTS, RINGS AND SIMILAR WORKPIECES

(71) Applicant: SECO/WARWICK S.A., Świebodzin (PL)

(72) Inventors: Maciej Korecki, Swiebodzin (PL); Wieslaw Fujak, Zbąszynek (PL); Józef Olejnik, Świebodzin (PL); Marek Stankiewicz, Zielona Góra (PL); Emilia Wolowiec-Korecka, Zgierz (PL)

(73) Assignee: SECO/WARWICK S.A., Swiebodzin (PL)

( * ) Notice: Subject to any disclaimer, the term of this patent is extended or adjusted under 35 U.S.C. 154(b) by 162 days.

(21) Appl. No.: 15/013,365

(22) Filed: Feb. 2, 2016

(65) Prior Publication Data

US 2016/0223259 A1 Aug. 4, 2016

(30) Foreign Application Priority Data

Feb. 4, 2015 (PL) ..... 411158

(51) Int. Cl.
*F27B 9/04* (2006.01)
*C21D 1/63* (2006.01)
(Continued)

(52) U.S. Cl.
CPC ..... *F27B 9/042* (2013.01); *C21D 1/06* (2013.01); *C21D 1/18* (2013.01); *C21D 1/58* (2013.01);
(Continued)

(58) Field of Classification Search
CPC ... C21D 1/06; C21D 1/18; C21D 1/58; C21D 1/62; C21D 1/63; C21D 1/773;
(Continued)

(56) References Cited

U.S. PATENT DOCUMENTS 4,132,393 A * 1/1979 Nakamura ..... B21B 45/0218 266/113
4,938,458 A * 7/1990 Nakajima ..... C21D 9/0037 148/222

(Continued)

*Primary Examiner* — Scott Kastler
*Assistant Examiner* — Michael Aboagye
(74) *Attorney, Agent, or Firm* — Oliff PLC

(57) ABSTRACT

Multi-chamber furnace for vacuum carburizing and quenching of gears, shafts, rings and similar components has at least two process chambers connected in parallel, with a continuous feeding mechanism for individual workpieces. Those chambers—the first one being a heating chamber, the second being a carburizing chamber and the third one diffusion chamber—are configured in a vertical arrangement, placed in a shared vacuum space with gas-tight division, whereas at the ends of each chamber there are incorporated heating chambers with thermal insulation, with a graphite heating system and stepping feeding mechanism incorporated in the core for the purpose of continuous feeding of individual workpieces. At the ends of those chambers the construction incorporates transport chambers featuring loading and unloading systems X-Y enabling cooperation with individual process chambers through thermal and gas-tight doors installed in chamber ends, while external access to the transport chambers is ensured through loading and unloading locks.

6 Claims, 3 Drawing Sheets

(51) Int. Cl.

| | |
|---|---|
| ***C21D 1/773*** | (2006.01) |
| ***F27B 9/02*** | (2006.01) |
| ***C21D 9/28*** | (2006.01) |
| ***C21D 9/40*** | (2006.01) |
| ***C21D 9/32*** | (2006.01) |
| ***C21D 1/58*** | (2006.01) |
| ***C23C 8/20*** | (2006.01) |
| ***C21D 1/06*** | (2006.01) |
| ***C21D 1/18*** | (2006.01) |
| ***C21D 1/62*** | (2006.01) |
| ***F27B 19/02*** | (2006.01) |

(52) U.S. Cl.
CPC ..... *C21D 1/62* (2013.01); *C21D 1/63* (2013.01); *C21D 1/773* (2013.01); *C21D 9/28* (2013.01); *C21D 9/32* (2013.01); *C21D 9/40* (2013.01); *C23C 8/20* (2013.01); *F27B 9/028* (2013.01); *F27B 9/029* (2013.01); *F27B 9/04* (2013.01); *F27B 19/02* (2013.01)

(58) Field of Classification Search
CPC .... C21D 9/28; C21D 9/32; C21D 9/40; C23C 8/20; F27B 19/02; F27B 9/028; F27B 9/029; F27B 9/04
USPC ..... 266/110, 249, 250
See application file for complete search history.

(56) References Cited

U.S. PATENT DOCUMENTS

| | | | | |
|---|---|---|---|---|
| 6,902,635 | B2 * | 6/2005 | Korwin | C21D 9/00 148/559 |
| 9,708,541 | B2 * | 7/2017 | Lampe | B01J 8/10 |
| 2011/0121493 | A1 * | 5/2011 | Saijo | C04B 35/64 264/434 |

* cited by examiner

MULTI-CHAMBER FURNACE FOR VACUUM CARBURIZING AND QUENCHING OF GEARS, SHAFTS, RINGS AND SIMILAR WORKPIECES

TECHNICAL FIELD

The present invention is a multi-chamber furnace for vacuum carburizing and quenching of gears, shafts, rings and similar workpieces.

BACKGROUND

There are documented examples of batch furnace solutions designed for executing vacuum carburizing processes, where numerous workpieces arranged over a flat tray are processed simultaneously, such arrangement being multiplied on anything between a few and around a dozen tray levels. Single-chamber furnaces with an integrated high-pressure gas quenching system (HPGQ) are used for this purpose, two-chamber furnaces with a separated HPGQ chamber, or solutions enabling cooling in quenching oil.

For the purpose of mass production, modular systems are manufactured with multiple process chambers for vacuum carburizing and a separated chamber for loading/unloading the workload to/from individual process chambers, including equipment for HPGQ or oil quenching. There are documented furnace constructions with in-line process chamber arrangement, or with a circular arrangement around the rotation axis of the above-described quenching chamber. Various mutations of modular systems are applied for industrial purposes, including those enabling placement of one process chamber on top of another, as presented in the patent description EP 1319724 B1. All those systems are characterised by volumetric method of workload quenching in circulating gas—e.g. nitrogen or helium under high pressure (HPGQ)—or in quenching oil, with non-uniform quenching of individual workpieces in different areas of the workload due to non-uniform and non-repeatable flow of the quenching medium through the workload volume, as well as due to non-uniform flow of the quenching medium along workpiece surfaces, which further translates into quenching stress and eventually undesirable deformations.

Compared with oil quenching, in this case gas cooling is characterized by a higher rate of statistical repeatability of deformations.

Patent description DE102009041041 B4, on the other hand, presents a modular system designed for direct carburizing and quenching of such workpieces as e.g. gears with limited dimensions, enabling fast gas heating and cooling with a potential to further reduce deformations and/or uniformity of those deformations within one workload as well as repeatability in successive workloads. According to this patent, heating chambers are installed in a vertical arrangement—from two to six in a single vacuum housing. Under this system, workpiece loading takes place at only one level, workpieces being arranged on the surface of one tray, preferably made of CFC composite. This enables very fast heating of workpieces exposed to good penetration (without screening) of radiation from the chamber heating system during the heating phase, which allows to reduce the time spent by workpieces at high temperature level, and to ensure safe (sufficiently short) process time spent by workpieces at the temperature of ca. 1050° C., in the range of faster grain growth. The furnaces are designed for carburizing with layer thickness up to ca. 0.6 mm, for example.

Gas quenching of workpieces arranged in a single layer allows to use the HPGQ method with high repeatability and consistency due to simpler construction of the cooling gas circulation system, with uniform and thorough gas flow onto the workpieces arranged on the tray surface. It is easier to achieve high consistency with proper flow speed, pressure and temperature in relation to the flow of the cooling gas through the volumetric workloads. Loading of the workpieces arranged in a single layer facilitates automation of workpiece loading and unloading operations, while the progress related to achieving reduction and repeatability of deformations allows to install the furnace in a machine tool system between machines for rough gear processing and machines for finishing operations, while eliminating the transportation of workpieces to organizationally separated quenching shops.

As regards gas carburizing technology, for challenging workpieces (where volumetric quenching in quenching oil leads to higher deformations) separate quenching of individual workpieces is applied in a quenching press, with cyclical feeding to the press by an operator usually supplied with a manipulator, or in mass production where industrial robots are used.

On the other hand, in the technology of quenching non-rigid bearing rings there are tests of installations for cyclical feeding of rings to the cooling matrix, enabling quenching with gas or compressed air, with a suitable inflow of the cooling medium through nozzles arranged in proper relation to cooled surfaces, with a suitable pressure, at speeds from 50 to 100 m/s, at the level of 10 mm from the surface, which guarantees achieving cooling speeds of e.g. 15° C./s—comparable with quenching oil—relevant for quenching steel rings made from 100Cr6 steel [HTM53(1998)2 "*Fixturhartung von Walzlagerringen unter Verwendug von gasformigen Abschreckmedien*"].

With reference to experiences relating to gas carburising technology—employing vacuum carburizing—attempts have been made to design furnaces for mass production of volumetric workloads, as described above, but featuring continuous flow of the workload through the furnace, its structure comprising functional chambers for: heating, vacuum carburizing, diffusion, pre-cooling before quenching, as well as a quenching chamber (e.g. oil quenching) with chamber separation as above, employing vacuum locks. Such systems have been described (among others) in patent descriptions EP 0735149 of 1996, EP 0828554 of 2004, EP 1482060 of 2004 and in technical literature from the turn of the 1990's. Unfortunately those technologies did not gain high popularity, mainly due to the level of deformations, non-uniformity of those deformations within one workload and between workloads, as well as due to the difficulty in maintaining continuous operation of the system.

Notably, there have been attempts to construct a continuously operated furnace intended for carburizing and quenching of individual workpieces fed through successive furnace systems designed for heating, carburizing, diffusion, pre-cooling and quenching. By way of example, there are systems described in patent description U.S. Pat. No. 4,938,458 (A) of 1990 "Continuous ion-carburizing and quenching system" and patent description EP 0811697 (B1) of 1997 "Method and apparatus for carburizing, quenching and tempering". Also at the turn of the 1990's, a continuous furnace structure was produced with workload feeding on rollers, divided into functional chambers (loading and unloading locks as well as heating, carburizing, diffusion and pre-cooling chambers) and HPGQ chambers, presented (among others) in the title page of HTM 2/2001 "Multichamber continuous furnaces . . . ". A new feature of this construction is the possibility of installing systems in line with machining solutions.

Production of toothed gears always includes the phases of rough and detailed machining—usually in the soft condition—as well as the phase of finishing individual gears after thermal and chemical treatment. Hence the continuous flow of individual workpieces for further processing after machining. Assuming that the technology of vacuum carburizing with direct quenching offers the effect of repeatable limitation of deformations and/or their repeatability relevant for the shape of workpieces, there is a demand for continuous process of carburizing and hardening of individual gears during a cycle corresponding to the cycle of machining for rough processing before thermo-chemical processing and finishing. Assuming a continuous flow of workpieces, cyclical (continuous) purging of individual workpieces after rough processing does not pose any technical or economic challenges.

SUMMARY

The essential feature of the multi-chamber furnace constituting the present invention is its structure containing at least two process chambers (connected in parallel) with continuous feeding of individual workpieces, configured in a vertical or horizontal arrangement, and placed in a shared vacuum space with gas-tight division, whereas at the ends of those chambers there are incorporated transport chambers featuring loading and unloading systems enabling cooperation with individual process chambers through thermal- and gas-tight doors installed in chamber ends, while external access to the transport chambers is ensured through loading and unloading locks.

Advantageously, the furnace features three process chambers configured in a vertical arrangement (one on top of another), namely heating, carburizing and diffusion chambers.

It is also advantageous when in each process chamber there are incorporated heating chambers with thermal insulation, with graphite heating system and a stepping feeding mechanism incorporated in the shaft for the purpose of continuous transfer of individual workpieces.

Further it is advantageous when the stepping mechanism offers between 2 and 100 steps of positioning individual workpieces, with a feeding time frame from 0.1 to 60 minutes.

Advantageously, the unloading lock should incorporate equipment for oil quenching of individual workpieces within a furnace operating cycle.

Furthermore, it is advantageous when the unloading lock incorporates equipment for oil quenching of individual workpieces on a press or in restraining devices within furnace operating cycle.

It is also advantageous when the unloading lock incorporates a device for gas quenching of workpieces within furnace operating cycle.

It is also beneficial when a device for gas quenching of individual details constitutes a two-part nozzle collector with a base and a system of gas nozzles forcing cooling gas flow at speeds up to 300 m/s, with nozzles in a configuration adjusted to the shape of individual details, with nozzle outlets at a distance between 1 and 100 mm from the cooled workpiece surface.

Moreover, it is advantageous when the nozzle collector has two movable parts, sliding towards the cooled workpiece, whereas an individual workpiece is placed on the base (by a loading mechanism) and positioned in a nominal position of nozzle collector closing for the cooling cycle.

It is also advantageous when the base has a rotary drive mechanism in order to ensure uniform exposure of individual workpiece surface during the cooling cycle.

Individual process chambers are designed for heating, low-pressure carburizing, and diffusion soaking cycles. This division is possible for LPC (low-pressure carburizing) cycle with carburizing layers in the range from 0.3 to 0.6 mm, assuming high-temperature carburizing, e.g. at 1050° C. Individual chambers have independent supplies of process gases for conducting successive phases of thermo-chemical processing, while it is advantageous if the chambers are separated by relevant thermo-gas resistant doors between zone chambers. For the purpose of solid and compact design, the three process chambers are placed one over another, which allows to incorporate two loading/unloading chambers connected to three zones, where each zone has a loading and unloading connection. Each chamber is fitted with a continuous workpiece feeding system, advantageously a stepping type.

Design of a furnace for low-pressure carburizing with high-pressure gas quenching of gears and workpieces with similar shapes—e.g. up to f=200 mm and weight=ca. 1.5 kg—made from steel, enabling short exposure to a temperature of ca. 1050° C., or employing a pre-nitriding process for typical commercial carburizing steel grades, in the heating phase according to the process and method presented in patent descriptions EP 1980641, U.S. Pat. No. 7,967,920 and PL 210958, with carburizing layers in the range from 0.25 to 1.0 mm. The method involves individual workpieces being loaded—through the loading lock—to the furnace divided into three process chambers, i.e. vacuum heating chamber, LPC (Low Pressure Carburising) chamber, and diffusion chamber, where the flow of workpieces through a continuous-type furnace is effected by the so-called stepping workpiece feeding mechanism along each chamber—from the loading to the unloading position.

Each process zone is constructed as a vacuum furnace with a vacuum housing, advantageously incorporating graphite thermal insulation and graphite heating elements. The bottom wall of the heating chamber, as above, incorporates a stepping workpiece feeding mechanism through the heating chamber—from the loading zone to the unloading position.

Each zone has a thermal and gas-tight door at the inlet and outlet, providing thermal and gas separation from the chambers with mechanisms transporting the workpieces between the zones. This means that there is a chamber connected to the loading lock, in which a transport mechanism is cyclically loading workpieces to the carburizing zone, while also unloading them from the vacuum carburizing zone and finally loading to the diffusion zone. The transport mechanism connected to the chamber with incorporated cooling mechanism is responsible for unloading workpieces from the heating zone and then loading them to the carburizing zone, while also unloading the workpieces after the diffusion cycle and transporting them to the cooling chamber. With this type of transport mechanism, it is advantageous to place one zone chamber on top of another.

The loading lock chamber is fitted with valves enabling air removal for each detail after loading procedure with an external mechanism, and before workpiece acceptance by the internal mechanism responsible for transport to the heating zone. Loading and unloading lock chambers are fitted with gas quenching sets with relevant equipment for nozzle-based gas cooling.

BRIEF DESCRIPTION OF DRAWINGS

The furnace according to the invention will be described in greater detail on the basis of the enclosed drawing example, in which respective figures represent.

DETAILED DESCRIPTION

Figure 1:
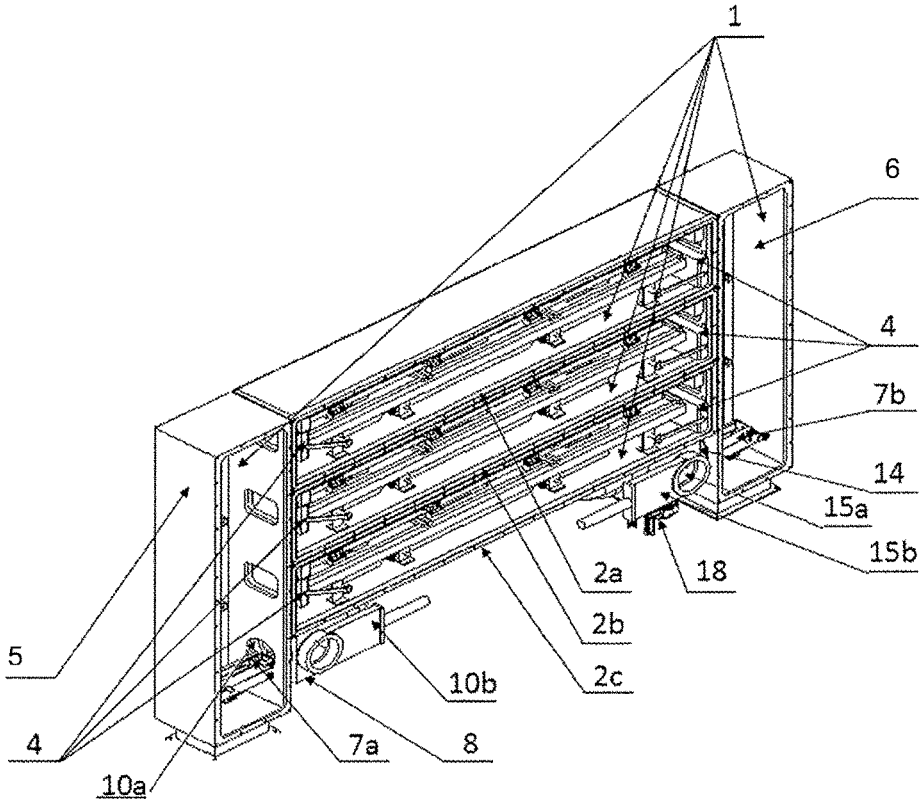
FIG. 1 illustrates a 3D view of the furnace.
Figure 2A:
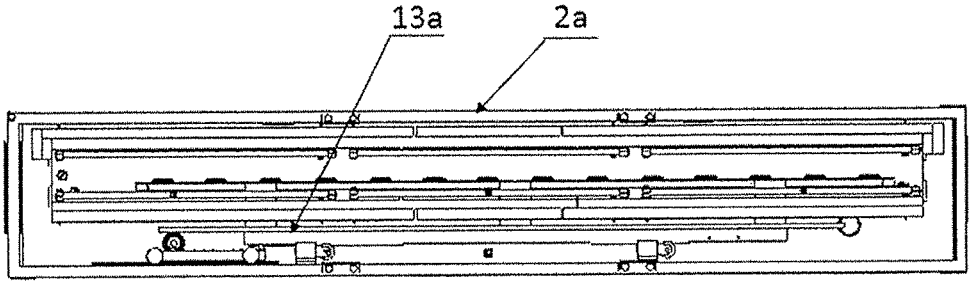
FIG. 2A illustrates a cross section side view of the heating chamber.
Figure 2B:
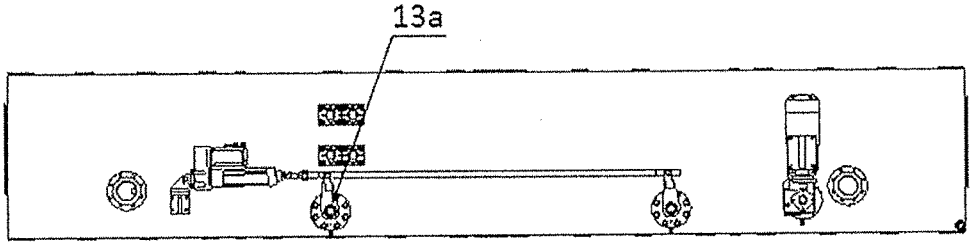
FIG. 2B illustrates a cross section top view of the heating chamber.
Figure 3:
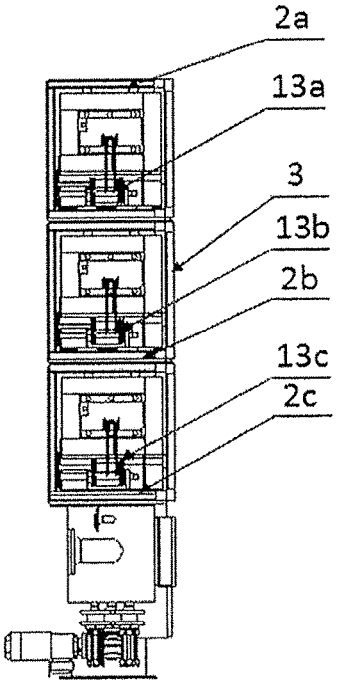
FIG. 3 illustrates a schematic diagram of the stepping mechanism enabling workpiece feeding inside the heating chamber.
Figure 4:
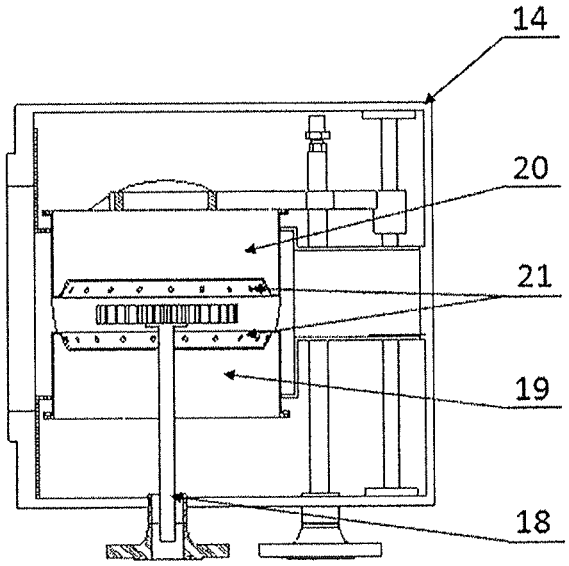
FIG. 4 illustrates a cross-section of the gas-cooling chamber for individual items.
Figure 5:
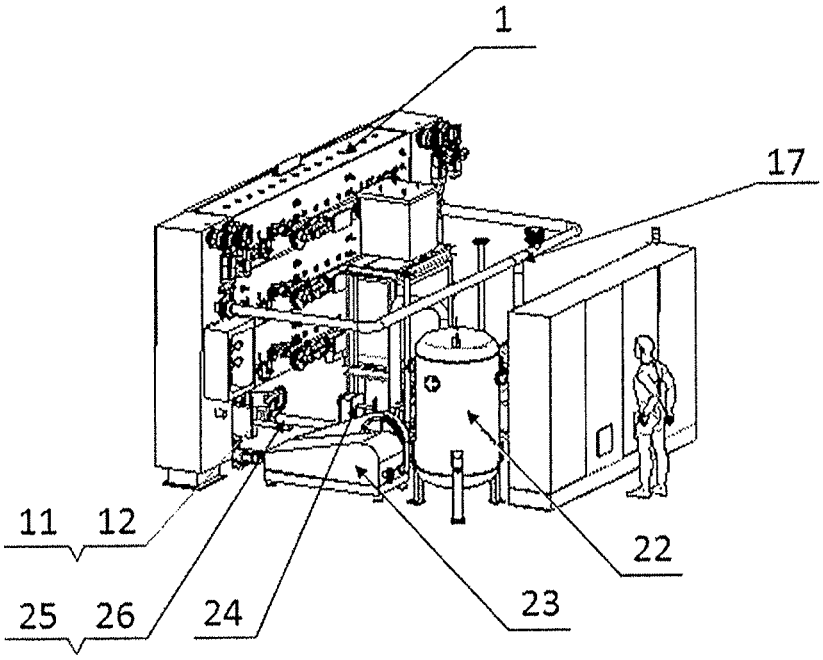
FIG. 5 illustrates a schematic diagram of the vacuum pump system and process gas system.

The furnace comprises a set of three process chambers sharing a vacuum housing 1, configured in a vertical arrangement (one over another) where the upper one is a heating chamber 2*a*, the middle one is a carburizing chamber 2*b*, and the bottom one is a diffusion chamber 2*c*, while each of those incorporates a heating chamber.

At the level of each process chamber, the vacuum housing is fitted with service and installation door 3 and—at heating chamber inlet and outlet—also with thermal and gas-tight doors 4, which separate process chambers from vacuum transport chambers 5 and 6 incorporated loading and unloading mechanisms X-Y 7*a* and 7*b* workpieces to and from respective chambers 2*a*, 2*b* and 2*c*.

Loading and unloading mechanisms X-Y 7*a* 7*b* operate vertically for the three process chambers 2*a*, 2*b* and 2*c* as well as loading lock 8 for chamber 6 and unloading lock 14 from chamber 5. The continuous flow of workpieces through the furnace is effected at pre-defined intervals of e.g. 0.5-2 minutes.

The workpiece intended for processing is placed in the loading position of the loading lock 8 by an external loading device. The lock is fitted with two vacuum valves 10*a* and 10*b*, advantageously of a slide straight-run valve type, and it is also connected to the vacuum system with a vacuum valve 11. After the workpiece is loaded as described above, the loading vacuum valve 10*b* is closed and a pump-out cycle follows until vacuum below 0.1 mbar is reached. Further, after purging vacuum level is reached, the outlet vacuum valve 10*a* opens and the workpiece is transferred to the vertical transport mechanism 7*a* in transport chamber 5. After closing valve 10*a* gas (e.g. nitrogen) is injected to the loading lock through the gas valve 12 and the transport mechanism X-Y 7*a*. Through the opened thermal and gas-tight doors of the upper heating chamber 2*a* the workpiece is placed in the start position of this zone. This chamber has e.g. 15 positions for workpiece placement where workpieces are gradually transferred by the stepping mechanism 13*a* incorporated in the core of the heating chamber.

After the workpiece is transferred to the final position in the heating chamber 2*a*, the loading and unloading mechanism X-Y 7*b*—placed in the transport chamber 6—collects the workpiece and places it in the first position of the stepping mechanism 13*b* of the carburizing chamber 2*b*, where the workpiece is transferred from the initial to the final position during the furnace operating cycle. Having reached the final position, the workpiece is collected by the loading/unloading mechanism 7*a* of the transport chamber 5 through the thermal and gas-tight doors 4 (opening at that moment) and is placed in the first position of the diffusion chamber 2*c*.

Having passed the workpiece through the diffusion chamber 2*c*, using the stepping mechanism 13*c* incorporated in the heating chamber, the loading/unloading mechanism X-Y 7*b* of the transport chamber 6 collects the workpiece and places it in the cooling position of the unloading lock 14.

The unloading lock 14 is equipped with two vacuum-pressure valves 15*a*/15*b*—one connected to the transport chamber 6 and the other ensuring workpiece removal from the furnace after cooling, using an external transport device. In the unloading lock 14—fitted with a valve connected to the pump system 17—there is equipment for individual gas cooling, operated as follows: the workpiece to be cooled is placed on the base 18, and a two-part nozzle collector is placed around the workpiece, with two movable parts—upper 19 and lower 20—sliding outwards during transport and closing during the cooling cycle. The collector is interchangeable, adapted individually to the shape of the workpiece. Movable parts 19 and 20 are fitted with a system for cooling gas distribution to the nozzle system 21 directed towards the surface of the workpiece to be cooled, and situated at a short distance from the surface, with a maximum coverage of the workpiece surface and fast line speed of discharged cooling gas. This construction is also characterised by easy outflow of expanded gas after cooling to the area of lock housing 14. During cyclical cooling of workpieces, the cooling gas is supplied to the nozzles 21 from the buffer tank 22 at a defined pressure, where the pressure level is determined by gas consumption and the outflow speed of cooling gas.

After flowing out of the nozzles 21 and hitting the workpiece surface, gas is expanded and next compressed—by the incorporated compressor 23—to a desired pressure; afterwards it is stored again in the buffer tank 22. The heat from workpiece-gas heat exchange is removed at the fitted heat exchanger 24, advantageously placed between the compressor 23 and the buffer tank 22. With cyclical cooling of individual workpieces and nozzle-based cooling with a high heat-exchange coefficient, a completely closed loop of cooling gas is achieved.

After the workpiece is cooled at a speed enabling quenching, and after valves 25 and 26 of the cooling gas recirculation system are closed (as described above), a vacuum/pressure valve 15*b* opens. The carburised and quenched workpiece is then removed through a passage, and transferred to finishing operations.

LIST OF DESIGNATIONS

1—vacuum housing
2*a*—heating chamber
2*b*—carburizing chamber
2*c*—diffusion chamber
3—service and installation door
4—thermal and gas-tight door
5, 6—transport chambers (with incorporated loading/unloading mechanisms for workpieces to and from individual process chambers)
7*a*, 7*b*—loading and unloading mechanisms X-Y
8—loading lock
10*a*, 10*b*—lock vacuum valves
11—vacuum valve
12—gas valve
13*a*, 13*b*, 13*c*—stepping mechanism
14—unloading lock

15*a*, 15*b*—vacuum-pressure valves
17—pump system
18—nozzle collector base
19, 20—movable part of the nozzle collector
21—gas nozzles for nozzle collector cooling
22—buffer tank
23—compressor
24—heat exchanger
25, 26—valves of the cooling gas recirculation system

The invention claimed is:

1. A multi-chamber furnace for vacuum carburizing and hardening of individual workpieces comprising a set of processing chambers located in a common vacuum housing and equipped with a combined transport system, wherein the set of processing chambers comprise three step pass-through chambers with parallel longitudinal axes, the three pass-through chambers comprising: a heating chamber, a carburizing chamber, and a diffusion chamber, which are arranged vertically over one another in the same order as listed, wherein each of the processing chambers comprises a graphite heating system and a thermal insulation, and a stepping mechanism incorporated in a furnace hearth of each of the processing chambers, and configured for horizontal movement of the individual workpieces, wherein the set of processing chambers is arranged between two vertically-parallel transport chambers and comprises loading and unloading mechanisms for the individual workpieces to and from each one of the respective processing chambers through thermal and gas-tight doors arranged at both ends of each of the processing chambers, and a loading and unloading lock configured to allow external access to the transport chambers, and wherein the unloading lock comprises equipment for quenching of individual workpieces within a furnace operating cycle.

2. The multi-chamber furnace according to claim 1, wherein the stepping mechanism offers between 2 and 100 steps positioning individual workpieces, with a movement timeframe 0.1 to 60 minutes.

3. The multi-chamber furnace according to claim 1, wherein the unloading lock is configured for oil quenching of individual workpieces on a hardening press or in restraining devices.

4. The multi-chamber furnace according to claim 1, wherein the unloading lock comprises a device for individual gas quenching of the individual workpieces.

5. The multi-chamber furnace according to claim 4, wherein the device for individual gas quenching of the individual workpieces comprises a two-part movable nozzle collector with a base, and a system of gas nozzles forcing cooling gas flow at speeds up to 300 m/s, the gas nozzles configured to be adjustable to conform to a desired shape.

6. The multi-chamber furnace according to claim 5, wherein the base has a rotatable drive.

* * * * *